US008400355B1

(12) United States Patent
Gaeta

(10) Patent No.: US 8,400,355 B1
(45) Date of Patent: Mar. 19, 2013

(54) PASSIVE PHOTONIC DENSE WAVELENGTH-DIVISION MULTIPLEXING TRUE-TIME-DELAY SYSTEM

(75) Inventor: Celestino John Gaeta, Carlsbad, CA (US)

(73) Assignee: Ipitek, Inc., Carlsbad, CA (US)

( * ) Notice: Subject to any disclaimer, the term of this patent is extended or adjusted under 35 U.S.C. 154(b) by 368 days.

(21) Appl. No.: 12/418,272

(22) Filed: Apr. 3, 2009

Related U.S. Application Data

(60) Provisional application No. 61/042,433, filed on Apr. 4, 2008.

(51) Int. Cl.
*H01Q 3/00* (2006.01)

(52) U.S. Cl. ..... 342/377; 342/368

(58) Field of Classification Search ..... 342/368–377; 398/115–117

See application file for complete search history.

(56) References Cited

U.S. PATENT DOCUMENTS

| | | | | |
|---|---|---|---|---|
| 4,736,463 | A * | 4/1988 | Chavez | 359/107 |
| 5,305,009 | A * | 4/1994 | Goutzoulis et al. | 342/157 |
| 5,374,935 | A * | 12/1994 | Forrest | 342/368 |
| 5,400,162 | A * | 3/1995 | Newberg et al. | 398/45 |
| 5,859,611 | A * | 1/1999 | Lam et al. | 342/368 |
| 6,124,827 | A * | 9/2000 | Green et al. | 342/375 |
| 6,204,947 | B1 * | 3/2001 | Page | 398/161 |
| 6,426,721 | B1 * | 7/2002 | Obara | 342/375 |
| 6,807,343 | B2 * | 10/2004 | Tulchinsky et al. | 385/39 |
| 7,084,811 | B1 * | 8/2006 | Yap | 342/375 |
| 7,633,977 | B2 | 12/2009 | Sanders et al. | |
| 2004/0090365 | A1 * | 5/2004 | Newberg et al. | 342/368 |

OTHER PUBLICATIONS

"Simple multiwavelength time-division multiplexed light source for sensing applications" Kraetschmer, T. et al. OPTICS LETTERS vol. 33 No. 7 posted Feb. 27, 2008 published Mar. 31, 2008.*

H.R. Fetterman et al., Optically Controlled Phased Array Radar Receiver Using SLM Switched Real Time Delays, IEEE Microwave and Guided Wave Lett., Nov. 1995, pp. 414-416, vol. 5, No. 11.

Paul J. Mattews et al., A Wide-Band Fiber-Optic True-Time-Steered Array Receiver Capable of Multiple Independent Simultaneous Beams, IEEE Photon. Tech. Lett., May 1998, pp. 722-724, vol. 10, No. 5.

Robert Taylor et al., Steering of an Optically Driven True-Time Delay Phased-Array Antenna Based on a Broad-Band Coherent WDM Architecture, IEEE Photon. Tech. Lett., Jan. 1998, pp. 144-146, vol. 10, No. 1.

Dennis R. Pape et al., New Wavelength Division Multiplexing True-Time-Delay Network for Wideband Phased Array Antennas, J. Opt. A.: Pure Appl. Opt. 1, Jan. 1999, UK.

Azad Siahmakoun, Optical Beamforming of Multiple Independent-Simultaneous RF Beams for Secure Communications, IEEE International Workshop on Measurement Systems, Contraband Detection and Personal Safety, Oct. 2006, pp. 15-19.

Dennis T. K. Tong et al., Multiwave Optically Controlled Phased-Array Antennas, IEEE Trans. on Microwave Theory and Tech., Jan. 1998, pp. 108-115, vol. 46, No. 1.

David F. Welch et al., The Realization of Large-Scale Photonic Integrated Circuits and the Associated Impact on Fiber-Optic Communication Systems, IEEE J. Lightwave Tech., Dec. 2006, pp. 4674-4683, vol. 24, No. 12.

* cited by examiner

*Primary Examiner* — Cassie Galt
(74) *Attorney, Agent, or Firm* — Burns & Levinson LLP; Jacob N. Erlich

(57) ABSTRACT

A photonic true time delay system for steering one or more radio frequency beams from an electronically scanned array antenna incorporates passive optical true time delay modules for the entire array based upon dense-wavelength-division multiplexed encoding of optical time delays. In addition, electronic selection of time delays allows for elimination of optical filter tuning and optical switching, and can function in either or both transmit and receive modes of the antenna array.

18 Claims, 10 Drawing Sheets

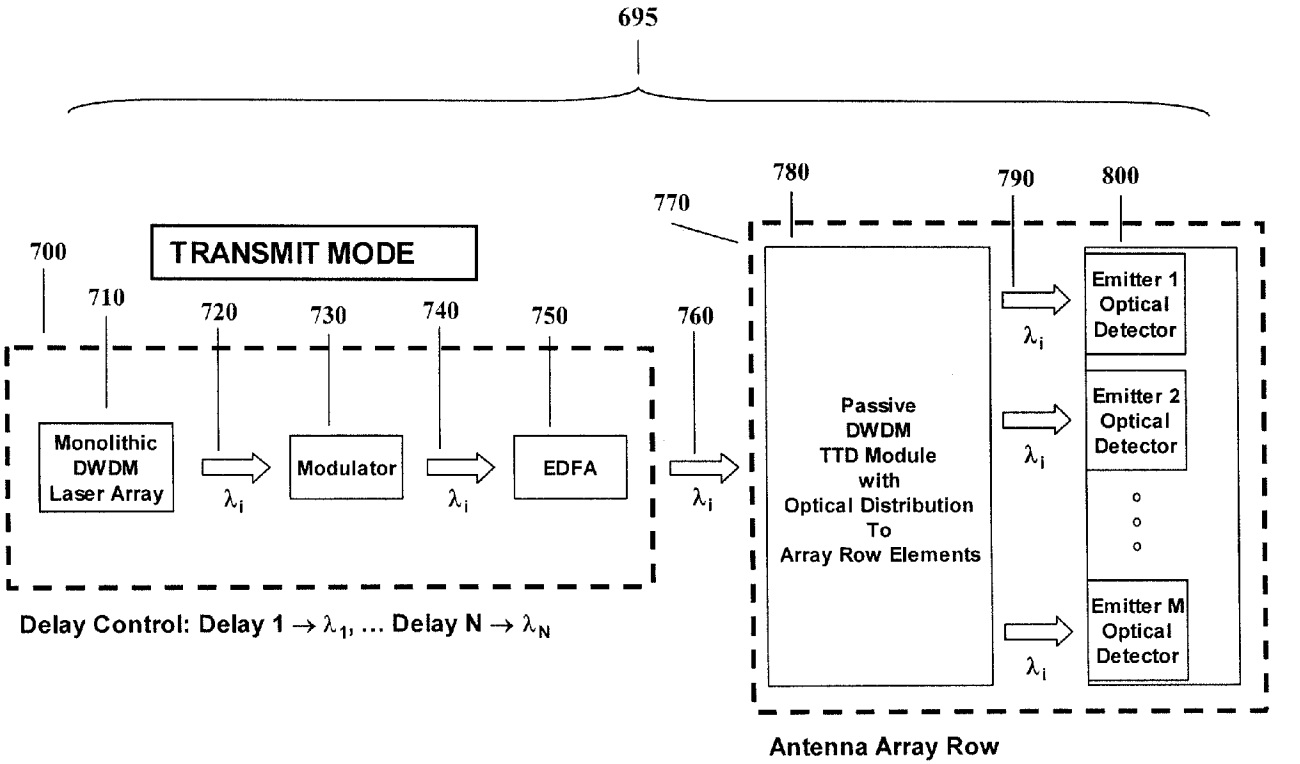

Wavelengths $\lambda_0, \lambda_1, \ldots \lambda_N$ set time delays between adjacent antenna elements.
One wavelength per pointing direction (only one laser in DWDM array is powered).
One delay control module for each row of elements in antenna array for low NF, high SFDR.
One optical detector at each antenna array emitter location.
One Delay Control,TTD Module, and Optical Detector per RF Beam for simultaneous multi-point.

Fig. 4

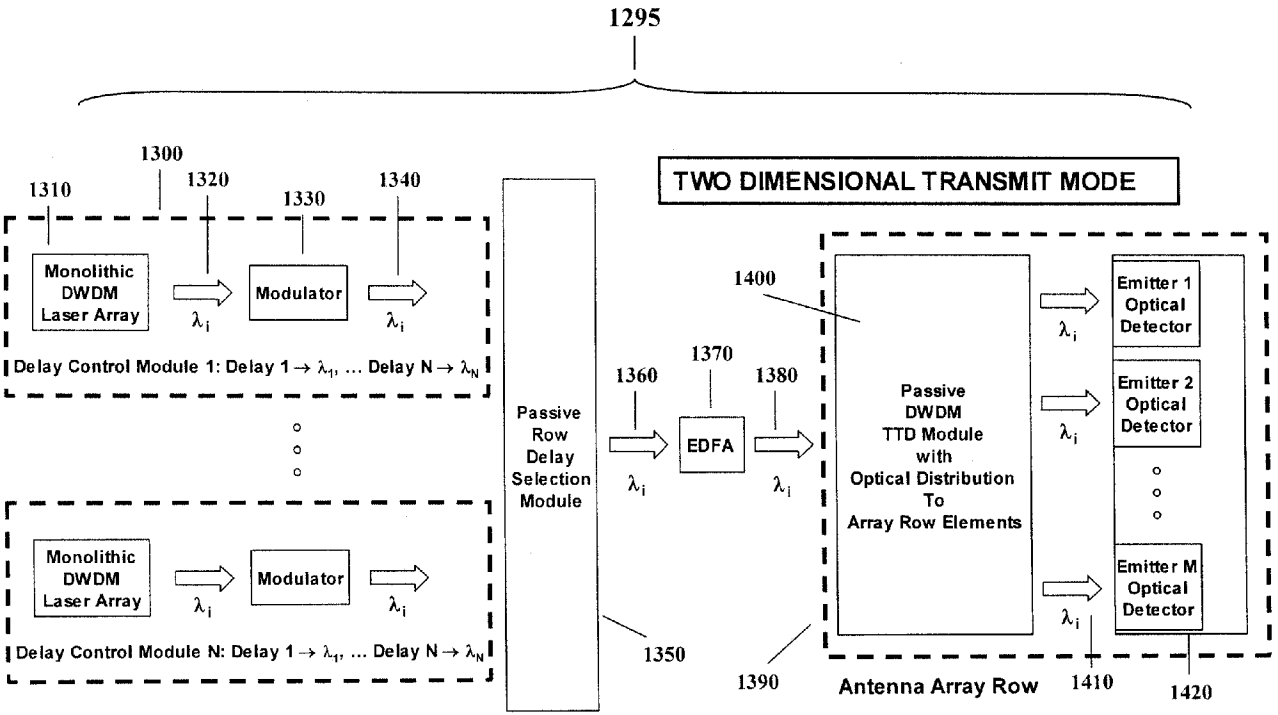

Delay Control Module n is selected for each row so that all rows combine to point in associated direction n in one dimension
Wavelengths $\lambda_i$ is selected in Delay Control Module n of each row to point row emitters in direction I that is in dimension orthogonal to the other (column) pointing dimension.
Passive Row Delay Selection Module sets time delays between rows of array that are dependent on which Delay Control Module is selected (note: selection is identical for all rows).
Two Dimensional Steering in N × N directions with same set of N wavelengths per Delay Control Module and N Delay Control Modules per row.

Fig. 8

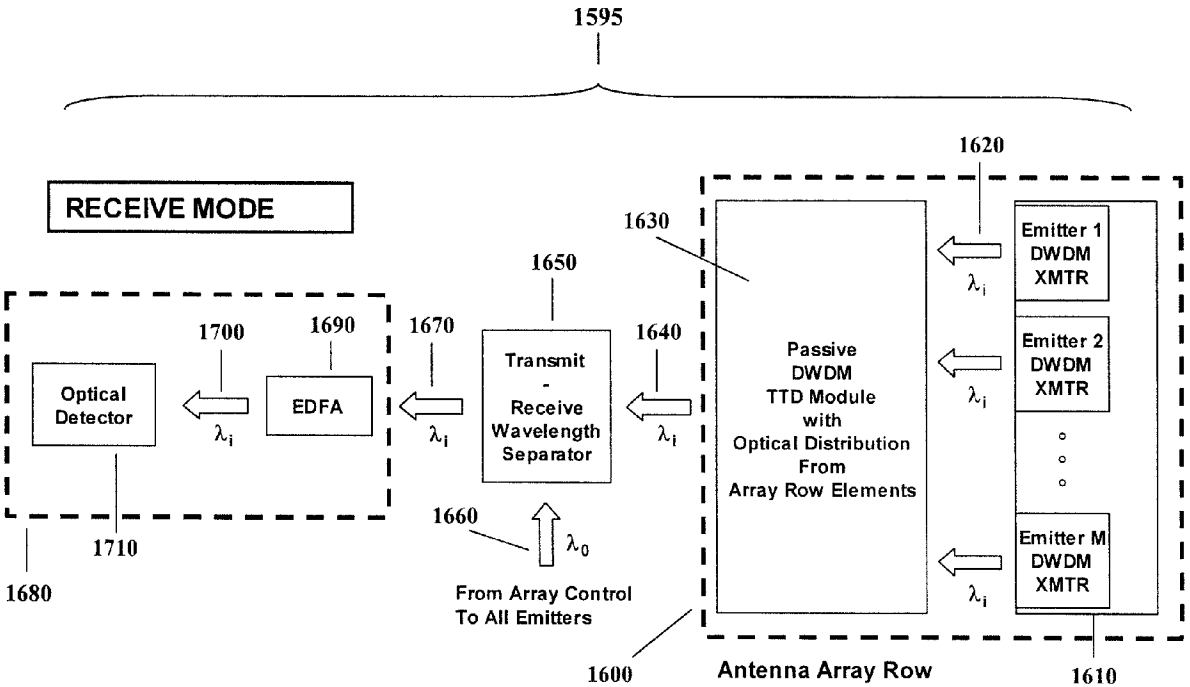

Same TTD module as for transmit mode using different set of N optical DWDM wavelengths interleaved with transmit-mode DWDM wavelengths.
Coarse wavelength separation in TTD module allows one transmit wavelength and one spectrally adjacent receive wavelength to share each delay path.
Fine wavelength separation is performed to separate transmit and receive functions.
DWDM transmitter (XMTR) at each antenna element contains DWDM laser array and one optical modulator – one laser selected via control data wavelength $\lambda_0$ sent from delay control sets receive mode operation.
Separate EDFA modules for transmit and receive for enhanced noise performance.

Fig. 9

PASSIVE PHOTONIC DENSE WAVELENGTH-DIVISION MULTIPLEXING TRUE-TIME-DELAY SYSTEM

CROSS REFERENCE TO RELATED APPLICATIONS

This application claims priority of provisional application Ser. No. 61/042,433 filed Apr. 4, 2008 entitled PASSIVE PHOTONIC DENSE WAVELENGTH-DIVISION MULTIPLEXING TRUE-TIME-DELAY SYSTEM WITH ELECTRONIC DELAY SELECTION and which provisional application is incorporated herein in its entirety.

STATEMENT REGARDING FEDERALLY SPONSORED RESEARCH OR DEVELOPMENT

A portion of this invention was made under United States Navy STTR contract number N68335-08-C-0332. The government may have certain rights to this invention.

BACKGROUND OF THE INVENTION

Various embodiments of this invention relate generally to phased array antenna systems, and, more particularly, to electronically scanned phased array antenna systems with photonic true time delay (TTD) that can produce one or multiple independently steered radio frequency (RF) beams, including those systems envisioned for use on, but not limited to, aircraft and cellular communication systems.

Wideband beamsteering presents a major problem because of the limited radio frequency bandwidth of electronic delay lines traditionally employed to scan the radio frequency beams from the antenna systems.

It is therefore a need to develop a low-cost, passive, wideband photonic true time delay system for steering electronically scanned radio frequency antenna arrays that is scalable to large arrays with thousands of elements.

It is a further need to provide a photonic true time delay system that is a universal solution for all electronically scanned radio frequency antenna arrays.

SUMMARY

The needs for the invention set forth above as well as further and other needs and advantages of the present invention are achieved by the embodiments of the invention described herein below.

The limitations of past approaches are overcome with a passive dense wavelength-division multiplexing (DWDM) photonics true time delay (TTD) system and electronic selection of time delays that may be implemented, but is not limited to implementation, in the following way:

- Single DWDM TTD Module for an Entire RF Antenna Array or for each Sub-Array of an RF Antenna Array
  - Optical wavelength per delay path or set of delay paths
  - Passive optical splitting
  - RF signal modulates all optical wavelengths except control data wavelength
  - Optical wavelengths arranged in groups for steering multiple RF beams
- Self-Addressed Data Packets for Switch Settings via Hard-Coded Switch Circuits
  - Data packet facilitates steering the antennaAntenna control signals encoded onto unique optical wavelength
- All optical wavelength paths (including control signal) combined and distributed to each antenna element Simple Electrical Delay Selector Integrated Circuit with some, or all, of the following: On-Board Optical Detector or Detector Array, DWDM Laser Array, and Hard-Coded Logic Circuits.

In an embodiment the passive optical true time delay system includes means for generating light at one or a plurality of optical wavelengths; means for modulating the light at the one or a plurality of optical wavelengths; means for distributing the modulated light at the plurality of optical wavelengths into a plurality of optical paths according to each one of the optical wavelengths of said light; each one of the plurality of optical paths incorporates an optical path length to achieve a predetermined optical propagation time interval;

means for selecting and optically detecting the modulated light having at least one of the optical wavelengths; and the means for selecting and optically detecting the modulated light having the at least one of said optical wavelengths outputting a plurality of radio frequency energies, each of the radio frequency energies relating to a different predetermined optical propagation time interval.

For a better understanding of the present invention, together with other and further needs thereof, reference is made to the accompanying drawings and detailed description and its scope will be pointed out in the appended claims.

BRIEF DESCRIPTION OF THE SEVERAL VIEWS OF THE DRAWINGS

FIG. 4 is a schematic block diagram illustration of an all-passive DWDM-based parallel-address approach for photonic true time delay control of RF phase-array antennas that is illustrated for a basic transmit mode to steer each row of the array in one dimension;

FIG. 8 is a schematic block diagram illustration of a passive optical TTD architecture for two-dimensional beam steering of an RF antenna array that is accomplished by assigning one delay-control module to each pointing direction in one dimension for each row, allowing for re-use of optical wavelengths that control steering in the orthogonal dimension;

FIG. 9 is a schematic block diagram illustration of an architecture for receive mode operation that is shown featuring simultaneous sharing of the TTD module used in transmit mode.

DETAILED DESCRIPTION

Figure 1:
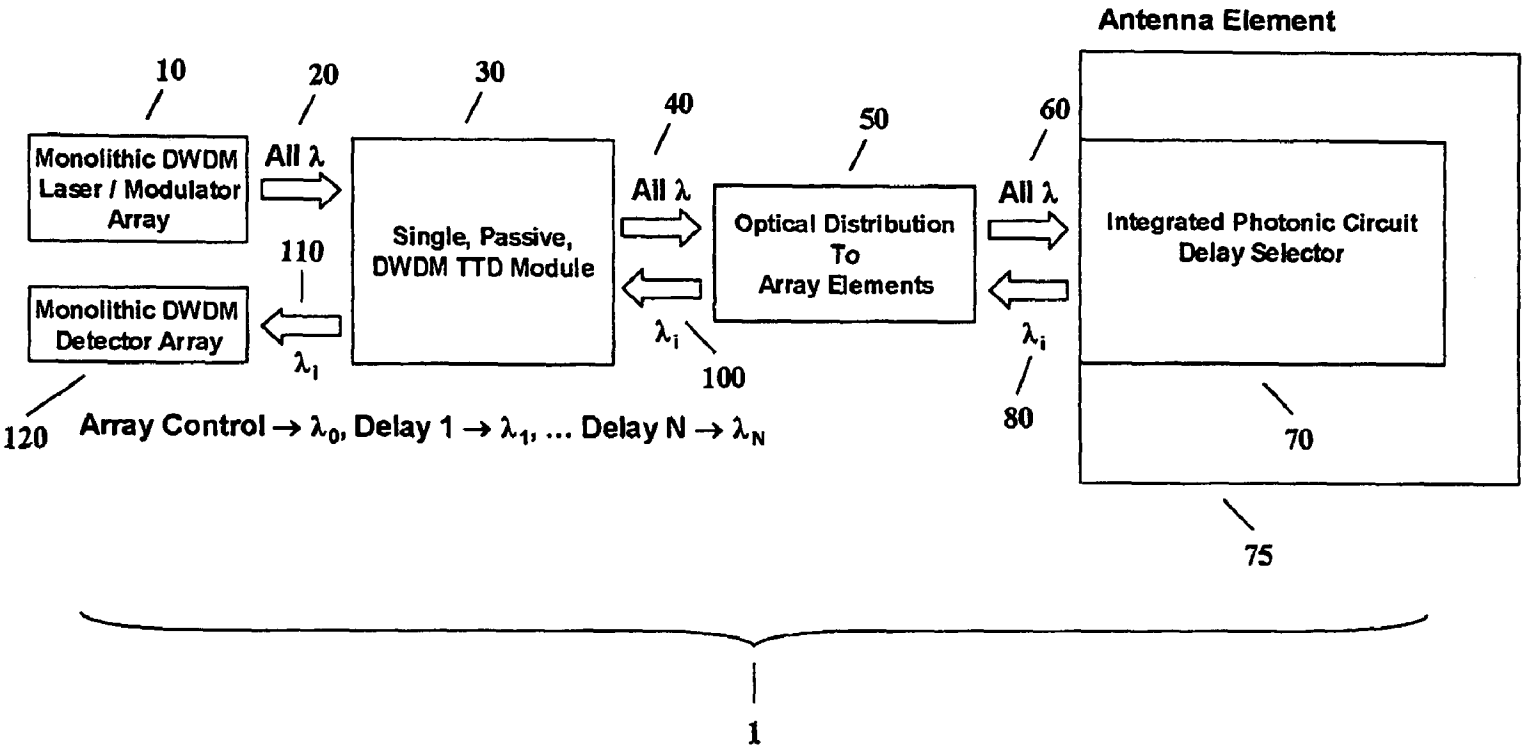
FIG. 1 is a schematic block diagram illustration of a passive, DWDM-based, parallel-address approach for photonic true time delay control of RF phase-array antennas with electronic selection of time delays.

Controlling electronically scanned array (ESA) antennas over a wide frequency range requires a special architecture including:

large arrays of wideband antenna elements with wide frequency ranges, e.g. 0.5 to 3 GHz, 3-18 GHz. Spiral and fractal antenna-element designs can provide this capability;

beamsteering algorithms to select the optimum combination of antenna-element radiators and phasing to control antenna beam direction and shape; and photonic signal delay lines, which can provide the time delays and bandwidth needed to control the wideband antenna elements.

Delay lines make up the heart of a beamsteering system. Each antenna signal must receive an exactly delayed RF signal based on desired beamsteering angle and location of the element in the wideband ESA antenna. The beamformer computes the signal delay and sends commands to the optical delay line array. Fiber optical cables carry an optical signal modulated with a particular signal frequency and format to the wideband array elements. The beamformer will send an optically coded transmit (T)/receive (R) control signal directly preceding the RF signal. This T/R signal sets an antenna T/R switch to the proper mode, and permits controlling the ESA antenna from a remote location with minimal connections.

One of the most basic photonic TTD concepts involves impressing the RF signal to be transmitted by the RF phased-array antenna onto an optical carrier that is subsequently split into separate paths to individually address each element in the array. A delay module must then be associated with each antenna element, along with the electrical cabling to provide the necessary switching voltages or other signal to the optical switches. This massively parallel approach requires a large number of delay modules and optical switch control, that can become extremely expensive to produce and cumbersome to implement and maintain.

Dispersive fiber elements have also been employed in an attempt to demonstrate a photonic true time delay phased array receiver. The output of a tunable laser is split into a number of paths that is equal to the number of antenna elements. The light in each path is passed through an optical modulator that is modulated with the RF signal detected by one antenna element assigned to that path. The modulated optical signals separately pass through dispersive optical fibers that provide a wavelength-dependent delay. Tuning the laser then steers the antenna array. Additional lasers could be added for a multi-RF beam receiver format. This approach requires tunable lasers and their control circuits, along with many optical interconnections and dispersive fiber elements. Furthermore, a relatively expensive optical modulator is required for each array element.

An alternate approach employs optical wavelength division multiplexing (WDM). The RF source separately modulates light at different wavelengths, with light at a given wavelength propagating into a unique delay path. This method has the advantage of implementing the delay paths with passive optical splitting and uses one delay module for the entire antenna array. After each optical wavelength is separately delayed, the various wavelengths may be combined into a common path that is later split to individually address each element in the antenna array (as in the basic concept above). At this point, means are used at each antenna element to extract the appropriate optical wavelength (time delay) before it is detected and converted back to an RF signal. Examples of such means include, but are not limited to, tunable local oscillator lasers and fixed wideband RF filters in a heterodyne detection method at each element, or optical tunable filters in an alternate approach. The disadvantage here is the relatively expensive local oscillator lasers or optical tunable filters that are necessary to select the appropriate optical wavelength for a single optical detector at each array element. A variation of these approaches dedicates one optical wavelength to each element in the array and employs a programmable delay module to independently control the time delay for each of the wavelengths. Clearly, this approach is not scalable to large arrays and requires a relatively complex delay module with active control.

One embodiment of the present invention utilizes architecture 1 for a passive, DWDM-based, simultaneous multiple-wavelength, parallel-address approach for photonic true time delay control of RF phase-array antennas with electronic selection of time delays shown in FIG. 1. This architecture allows for both transmit and receive operating modes in the antenna array system that could operate independently and simultaneously.

An optical source such as, but not limited to, a monolithic DWDM laser/optical modulator array 10 emits electromagnetic radiation such as light 20 in a plurality of optical wavelengths including, but not limited to, ITU wavelength grid of 50 GHz to 100 GHz spacing from 1491.88 nm to 1611.79 nm wavelength. Each optical wavelength carries RF modulation to be transmitted from an ESA antenna, or ESA control signals for ESA steering in either transmit or receive modes of operation, or both RF modulation and ESA control signals. The light 20 subsequently enters a passive DWDM TTD module 30. The passive DWDM TTD module 30 causes each optical wavelength of the light 20 to be delayed by an interval of time predetermined for that optical wavelength and subsequently outputs all time-delayed optical wavelengths as light 40. The predetermined intervals of time are given by the phase relationships required between elements of a phased array antenna to cause the RF energy emitted by the elements of the phase array antenna to add constructively (in-phase) in a spatial pointing direction. The light 40 then enters an optical distribution module 50 such as, but not limited to, fiber or integrated optical waveguide splitters wherein the optical distribution module 50 distributes the light 40 to each ESA antenna element delay module 70 as light 60. The ESA antenna element delay module 70 functions to electronically extract RF modulation and ESA antenna steering control data from one or more of the optical wavelengths in the light 40. The extracted RF modulation is then available for transmission from an ESA antenna element 75. This function will be described in the presentations of the device embodiments shown schematically in FIG. 2 and FIG. 3.

In a receive mode of operation, RF modulation received by the ESA antenna element 75 modulates light 80 generated by the ESA antenna element delay module 70 at a selected optical wavelength determined by control data carried by the light 60. The receive function will be described in the presentations of the device embodiments shown schematically in FIG. 2 and FIG. 3. Still referring to FIG. 1, the light 80 is collected by the optical distribution module 50, wherein the optical distribution module 50 combines a plurality of the light 80 from a plurality of the ESA antenna element delay modules 70 to form light 100, wherein the light 100 may contain a plurality of optical wavelengths. The light 100 subsequently enters the passive DWDM TTD module 30 that causes each optical wavelength of the light 100 to be delayed by an interval of time predetermined for that optical wavelength and subsequently outputs all time-delayed optical wavelengths as light 110. The predetermined intervals of time are given by the phase relationships required between elements of a phased array antenna to cause the RF energy received by the elements of the phase array antenna to add constructively (in-phase) in a spatial pointing direction for reception of the RF energy. A detector array 120 such as, but not limited to, a monolithic optical detector array then detects the light 110 and extracts the RF modulation from the light 110.

Figure 2:
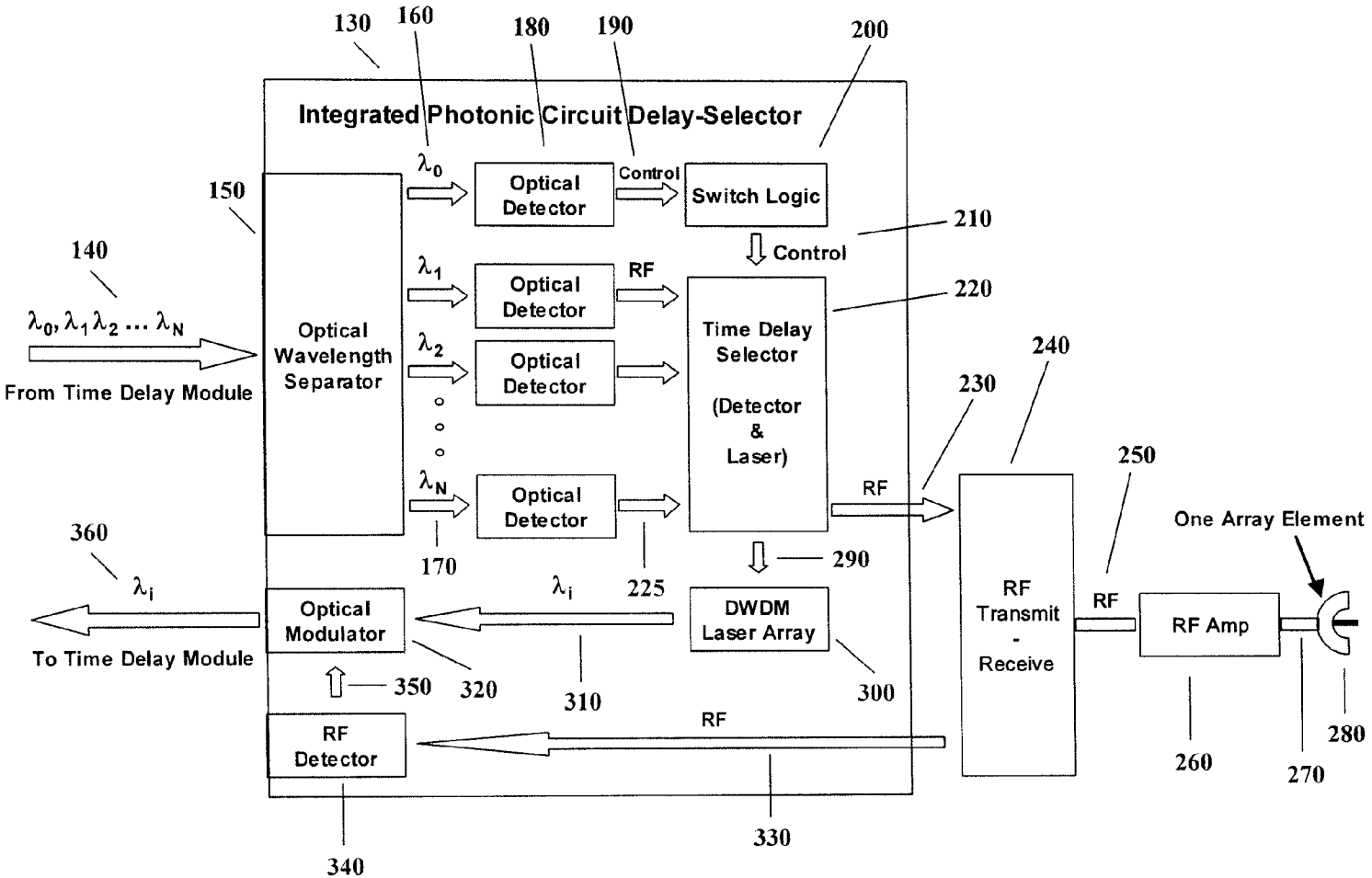
FIG. 2 is a schematic block diagram illustration of an integrated photonic circuit delay-selector implemented with on-board wavelength separation.

In the device embodiment illustrated schematically in FIG. 2, the ESA antenna element delay module 70 of FIG. 1 includes an integrated photonic circuit delay-selector 130. DWDM light 140 (60) at multiple (quantity equal to N+1) DWDM wavelengths ($\lambda_0, \lambda_1, \lambda_2, \ldots \lambda_N$) enters the integrated photonic circuit delay-selector 130, and is subsequently separated by an optical wavelength separator 150 such as, but not limited to, an asymmetrical waveguide grating (AWG) or a thin-film optical interference filter, into light 160 at wavelength $\lambda_0$ and a plurality of light 170 at wavelengths ($\lambda_1, \lambda_2, \ldots \lambda_N$), wherein the light 160 contains ESA control data and the light 170 contains RF modulation to be transmitted. The light 160 and the light 170 are detected by an optical detector array 180, wherein each of the optical detectors 180 detects one optical wavelength of the plurality of optical wavelengths in the light 160 and the light 170.

The electrical control signal 190 detected from the light 160 is subsequently input to a switch logic circuit 200 that generates a control signal 210. The control signal 210 operates a time delay selector circuit 220 that sends one or more RF outputs from the plurality of RF outputs 225 of the optical detector array 180 as an RF signal 230 that sequentially propagates through an RF transmit/receive module 240, a bi-directional RF segment 250, an RF amplifier 260, a bi-directional RF segment 270, and ESA antenna element 280. The ESA antenna element 280 subsequently transmits the RF signal 230. Thus, control signal 210 controls which direction of transmission from the antenna array will be used, and time delay selector circuit 220 chooses the appropriately delayed RF signals 225 to produce that direction of transmission.

In an RF receive mode, the control signal 210 operates the time delay selector circuit 220 to output a control signal 290 that causes a DWDM laser array 300 to generate light 310 at one or more optical wavelengths $\lambda_i$ that subsequently enters an optical modulator 320. RF signals received by the ESA antenna element 280 sequentially propagates through the bi-directional RF segment 270, the RF amplifier 260, the bi-directional RF segment 250, and the RF transmit/receive module 240. Next the RF transmit/receive module 240 outputs an RF signal 330 that is input to an RF detector 340, wherein the detected RF signal 350 from the RF detector 340 modulates the light 310 via the optical modulator 320. Finally, the optical modulator 320 outputs light 360 (80) at wavelengths $\lambda_i$ that has been modulated with the detected RF signal 350 for subsequent processing as the light 100 of FIG. 1 by the passive DWDM TTD module 30 of FIG. 1.

Figure 3:
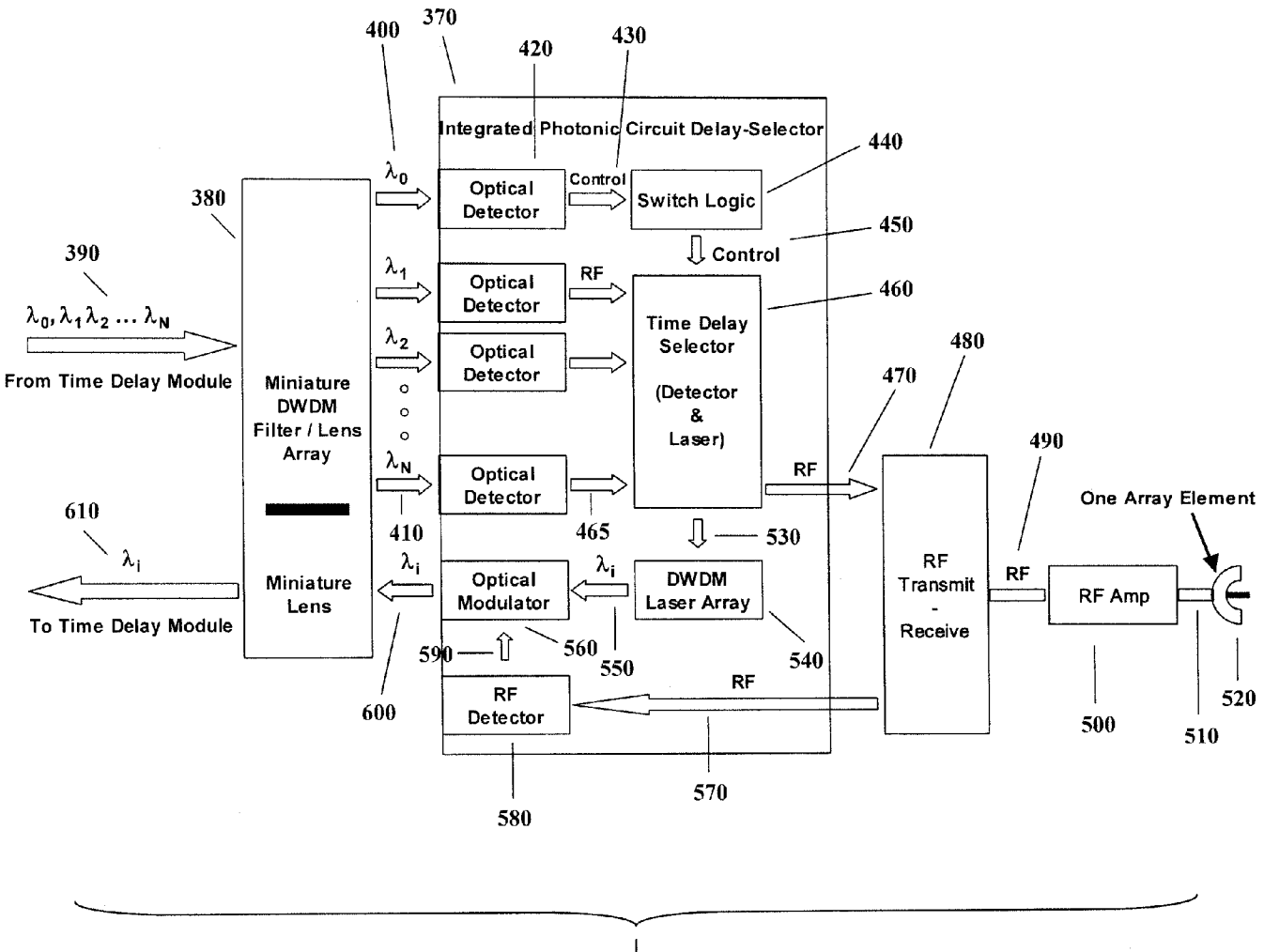
FIG. 3 is a schematic block diagram illustration of an integrated photonic circuit delay-selector implemented using a miniature DWDM segmented optical filter and a micro-lens array.

An alternate embodiment is shown in FIG. 3. In this embodiment, the ESA antenna element delay module 70 of FIG. 1 includes a delay selector 370 such as, but not limited to, an integrated photonic circuit delay-selector and an external miniature DWDM filter/lens array 380. DWDM light 390 (60) at multiple (quantity equal to N+1) DWDM wavelengths ($\lambda_0, \lambda_1, \lambda_2, \ldots \lambda_N$) enters the external miniature DWDM filter/lens array 380, wherein the DWDM filter includes, but is not limited to, an asymmetrical waveguide grating (AWG) or a thin-film optical interference filter, and is subsequently separated into light 400 at wavelength $\lambda_0$ and a plurality of light 410 at wavelengths ($\lambda_1, \lambda_2, \ldots \lambda_N$), wherein the light 400 contains ESA control data and the light 410 contains RF modulation to be transmitted. The light 400 and the light 410 are detected by an optical detector array 420 in the integrated photonic circuit delay-selector 460, wherein each of the optical detectors comprising the optical detector array 420 detects one optical wavelength of the plurality of optical wavelengths in the light 400 and the light 410.

The electrical control signal 430 detected from the light 400 is subsequently input to a switch logic circuit 440 that generates a control signal 450. The control signal 450 operates a time delay selector circuit 460 that sends one or more RF outputs from the plurality of RF outputs 465 of the optical detector array 420 as an RF signal 470 that sequentially propagates through an RF transmit/receive module 480, a bi-directional RF segment 490, an RF amplifier 500, a bi-directional RF segment 510, and ESA antenna element 520. The ESA antenna element 520 subsequently transmits the RF signal 470.

In an RF receive mode, the control signal 450 operates the time delay selector circuit 460 to output a control signal 530 that causes a DWDM laser array 540 to generate light 550 at one or more optical wavelengths $\lambda_i$ that subsequently enters an optical modulator 560. RF signals received by the ESA antenna element 520 sequentially propagates through the bi-directional RF segment 510, the RF amplifier 500, the bi-directional RF segment 490, and the RF transmit/receive module 480. Next the RF transmit/receive module 480 outputs an RF signal 570 that is input to an RF detector 580, wherein the detected RF signal 590 from the RF detector 580 modulates the light 550 via the optical modulator 560. Finally, light 600 at wavelengths $\lambda_i$ that has been modulated with the detected RF signal 590 via the optical modulator 560 is collected by the external miniature DWDM filter/lens array 380 and output as light 610 (80) for subsequent processing by the passive DWDM TTD module 30 of FIG. 1.

In another embodiment, a basic transmit architecture 695 for a passive, DWDM-based, wavelength-selection, parallel-address approach for photonic true time delay control of RF phase-array antennas with electronic selection of time delays is shown in FIG. 4.

A delay-control module 700 contains an optical source 710 such as, but not limited to, a monolithic DWDM laser/optical modulator array that emits light 720 in one of a plurality of optical wavelengths, such as, but not limited to, the ITU wavelength grid of 50 GHz to 100 GHz spacing from 1491.88 nm to 1611.79 nm wavelength. The light 720 enters a modulator 730 and exits the modulator as light 740, wherein the light 740 carries RF modulation, to be transmitted from an ESA antenna, imposed by the modulator 730 onto the light 720. The light 740 is amplified by an optical amplifier 750 such as, but not limited to, an erbium-doped fiber amplifier (EDFA), and output as light 760 that is directed to an ESA antenna array row 770. The light 760 subsequently enters a passive DWDM TTD/optical distribution module 780. The passive DWDM TTD/optical distribution module 780 distributes the light 760 as light 790 in a plurality of optical paths, wherein the light 790 is delayed by an interval of time predetermined for each path and each optical wavelength of the light 790 relative to the other paths and other optical wavelengths. Delay module 780 includes a separate set of delay paths for each wavelength, which separate sets of delay paths each produces the predetermined set of delays needed for each antenna element to provide the corresponding direction of transmission for the respective wavelength. The predetermined intervals of time are given by the phase relationships required between elements of a phased array antenna to cause the RF energy emitted by the elements of the phase array antenna to add constructively (in-phase) in a spatial pointing direction. Each path of the light 790 is directed to one of a plurality of ESA antenna element emitter optical detectors 800, wherein each one of the plurality of ESA antenna element emitter optical detectors 800 detects the light 790, thereby extracting RF modulation that is then available for transmission.

Figure 5:
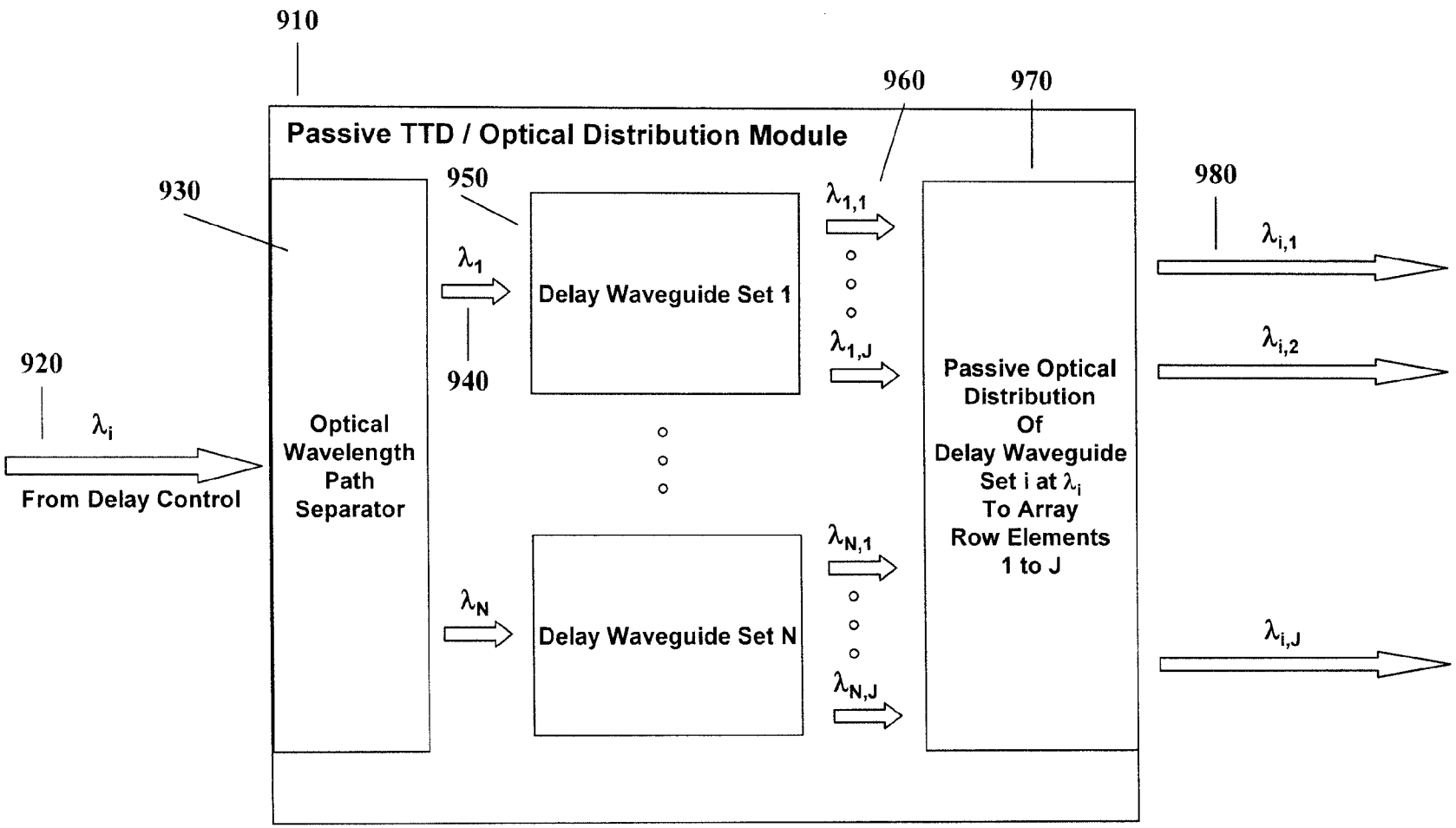
FIG. 5 is a schematic block diagram illustration of a passive TTD/Optical Distribution Module that imposes appropriate time delays between light paths feeding RF emitters in a given row of an antenna array that depend upon the (single) input optical wavelength.

A functional embodiment of a passive DWDM TTD/optical distribution module 910 (780) for a wavelength-selection TTD approach is shown in FIG. 5. Light 920 (760) at optical wavelength $\lambda_i$ enters a means 930 for separating light according to the optical wavelength of the light 920 into light 940 in a plurality of optical paths. The light 940 enters one of a plurality of delay waveguide sets 950 based upon the optical wavelength of the light 940. Each one of the plurality of delay waveguide sets 950 distributes the light 940 as light 960 in a plurality of optical paths, wherein the light 960 is delayed by an interval of time predetermined for each path and each optical wavelength of the light 960 relative to the other paths and optical wavelengths. The light 960 enters a means 970 such as, but not limited to, an asymmetrical waveguide grating (AWG) or a thin-film optical interference filter, for distributing the light 960 into light 980 (790) in a plurality of optical paths, wherein each one of the plurality of optical paths of the light 980 is comprised of a unique path of the light 960 from each of the delay waveguide sets 950.

Figure 6:
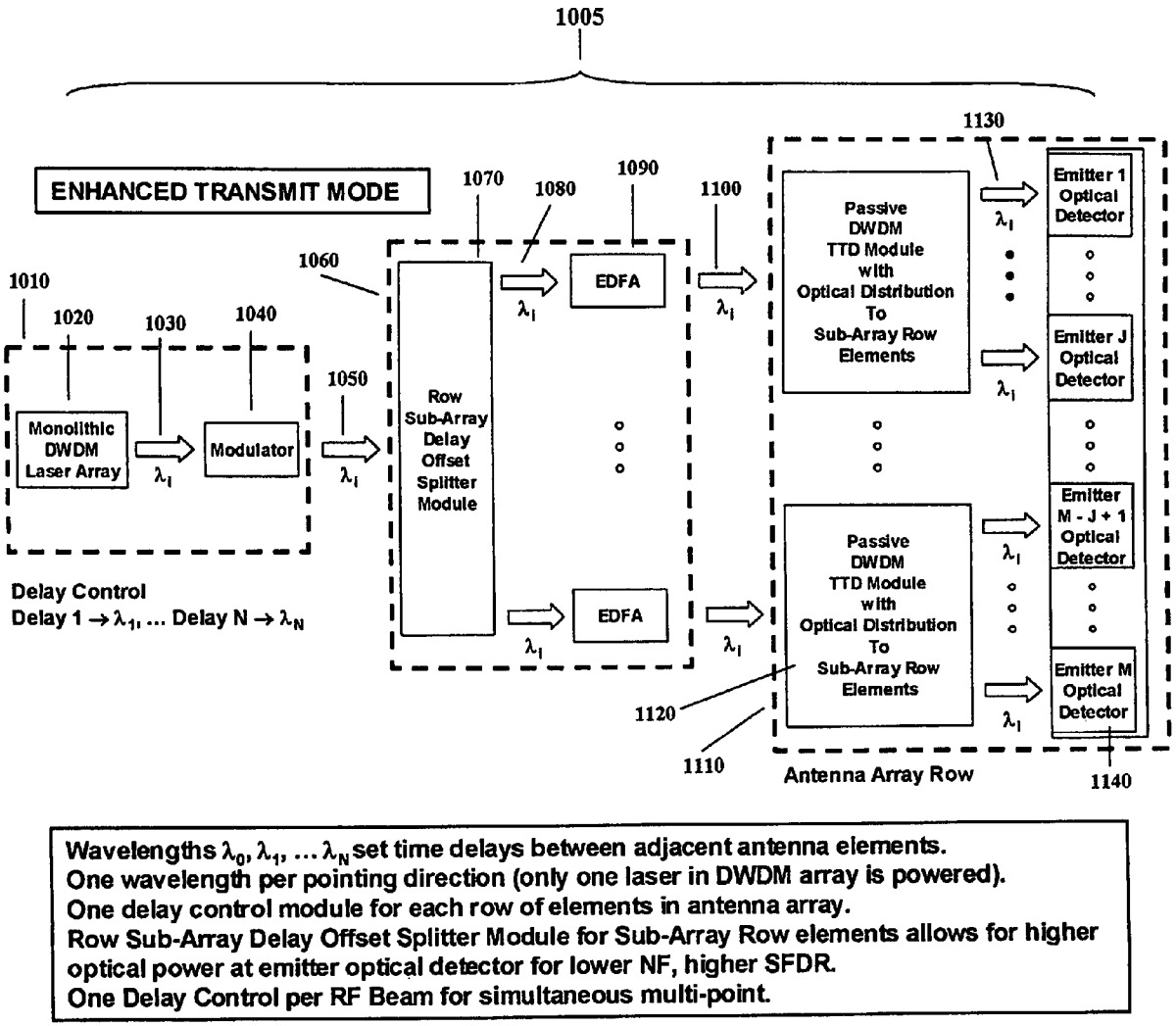
FIG. 6 is a schematic block diagram illustration of an enhanced transmit mode that allows for separation of light to address row sub-arrays to provide higher detected optical power at each emitter location for improved noise performance.

A further embodiment of an enhanced transmit mode architecture 1005 for a passive, DWDM-based, wavelength-selection, parallel-address approach for photonic true time delay control of RF phase-array antennas with electronic selection of time delays is shown in FIG. 6.

As shown in FIG. 6, a delay-control module 1010 contains an optical source 1020 such as, but not limited to, a monolithic DWDM laser/optical modulator array that emits light 1030 in one of a plurality of optical wavelengths such as, but not limited to, the ITU wavelength grid of 50 GHz to 100 GHz spacing from 1491.88 nm to 1611.79 nm wavelength. The light 1030 enters a modulator 1040 and exits the modulator as light 1050, wherein the light 1050 carries RF modulation, to be transmitted from an ESA antenna, imposed by the modulator 1040 onto the light 1030.

The light 1050 subsequently enters a row sub-array delay offset splitter module 1070. The row sub-array delay offset splitter module 1070 distributes the light 1050 as light 1080 in a plurality of optical paths, wherein the light 1080 is delayed by a interval of time predetermined for each path and each optical wavelength of the light 1080 relative to the other paths. The predetermined intervals of time are given by the phase relationships required between elements of a phased array antenna to cause the RF energy emitted by the elements of the phase array antenna to add constructively (in-phase) in a spatial pointing direction. Each path of the light 1080 is directed to one of a plurality of optical amplifier modules 1090 such as, but not limited to, EDFA modules. Each of the plurality of optical amplifier modules 1090 amplifies the light 1080 to produce light 1100 in a plurality of paths that is directed to an ESA antenna array row 1110, wherein the light 1100 in each of the plurality of paths enters one of a plurality of passive DWDM TTD/optical distribution modules 1120. Each one of the plurality of passive DWDM TTD/optical distribution modules 1120 distributes the light 1100 as light 1130 in a plurality of optical paths, wherein the light 1130 is delayed by an interval of time predetermined for each path and each optical wavelength of the light 1130 relative to the other paths and optical wavelengths. Each path of the light 1130 is directed to one of a plurality of ESA antenna element emitter optical detectors 1140, wherein each one of the plurality of ESA antenna element emitter optical detectors 1140 detects the light 1130, thereby extracting RF modulation that is then available for transmission.

Figure 7:
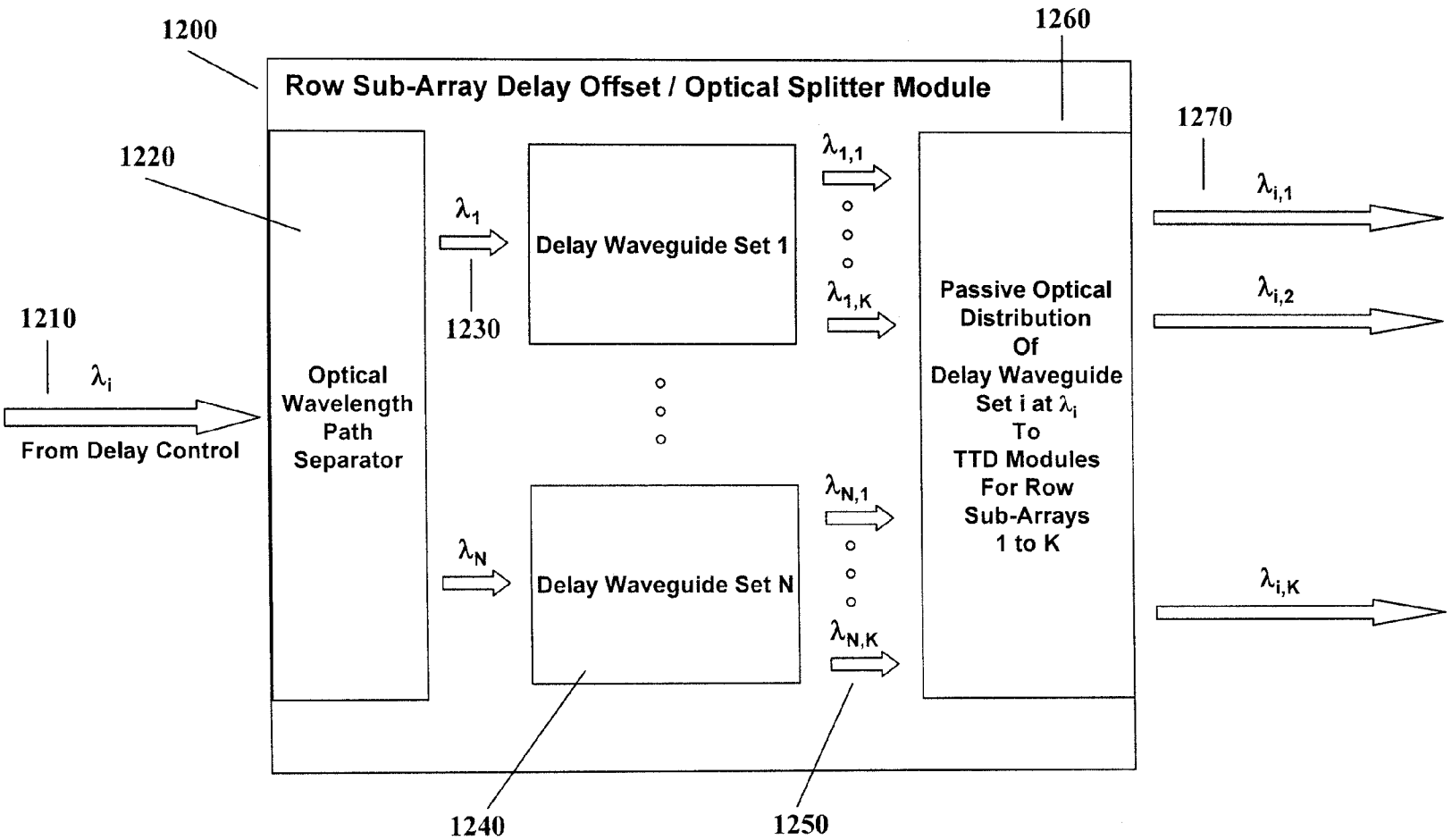
FIG. 7 is a schematic block diagram illustration of a row sub-array delay offset splitter module for use in an enhanced transmit mode.

An embodiment of a row sub-array delay offset splitter module 1200 (1070) for a wavelength-selection TTD approach is shown in FIG. 7. Light 1210 (1050) at optical wavelength $\lambda_i$ enters a means 1220 such as, but not limited to, an asymmetrical waveguide grating (AWG) or a thin-film optical interference filter, for separating light according to the optical wavelength of the light 1200 into light 1230 in a plurality of optical paths. The light 1230 enters one of a plurality of delay waveguide sets 1240 based upon the optical wavelength of the light 1230. Each one of the plurality of delay waveguide sets 1240 distributes the light 1230 as light 1250 in a plurality of optical paths, wherein the light 1250 is delayed by an interval of time predetermined for each path and each optical wavelength of the light 1250 relative to the other paths and optical wavelengths. The predetermined intervals of time are given by the phase relationships required between elements of a phased array antenna to cause the RF energy emitted by the elements of the phase array antenna to add constructively (in-phase) in a spatial pointing direction. The light 1250 enters a means 1260 for distributing the light 1250 into light 1270 (1080) in a plurality of optical paths, wherein each of the plurality of optical paths of the light 1270 is comprised of a unique path of the light 1270 from each of the delay waveguide sets 1240.

In another embodiment, a two-dimensional transmit architecture 1295 for a passive, DWDM-based, wavelength-selection, parallel-address approach for photonic true time delay control of RF phase-array antennas with electronic selection of time delays is shown in FIG. 8.

Each one of a plurality of delay-control modules 1300 contains an optical source 1310 such as, but not limited to, a monolithic DWDM laser/optical modulator array that emits light 1320 in one of a plurality of optical wavelengths such as, but not limited to, the ITU wavelength grid of 50 GHz to 100 GHz spacing from 1491.88 nm to 1611.79 nm wavelength. The light 1320 enters a modulator 1330 and exits the modulator 1330 as light 1340, wherein the light 1340 carries RF modulation, to be transmitted from an ESA antenna, imposed by the modulator 1330 onto the light 1320.

The light 1340 from the modulator 1330 of each one of the plurality of delay-control modules 1300 enters a passive row delay selection module 1350, wherein the passive row delay selection module 1350 causes the light 1340 from each one of the plurality of delay-control modules 1300 to be delayed by an interval of time predetermined for each one of the plurality of delay-control modules 1300 relative to the other delay-control modules 1300 but substantially not dependent upon the optical wavelength, and outputs light 1360.

The light 1360 is amplified by an optical amplifier 1370 such as, but not limited to, an EDFA, and output as light 1380 that is directed to an ESA antenna array row 1390. The light 1380 subsequently enters a passive DWDM TTD/optical distribution module 1400. The passive DWDM TTD/optical distribution module 1400 distributes the light 1380 as light 1410 in a plurality of optical paths, wherein the light 1410 is delayed by a interval of time predetermined for each path and each optical wavelength of the light 1410 relative to the other paths and other optical wavelengths. Each path of the light 1410 is directed to one of a plurality of ESA antenna element emitter optical detectors 1420, wherein each one of the plurality of ESA antenna element emitter optical detectors 1420 detects the light 1410, thereby extracting RF modulation that is then available for transmission.

An embodiment of a receive architecture 1595 for a passive, DWDM-based, wavelength-selection, parallel-address approach for photonic true time delay control of RF phase-array antennas with electronic selection of time delays is shown in FIG. 9.

In each ESA antenna array row 1600, each one of a plurality of ESA antenna element emitters such as, but not limited to, DWDM transmitters (XMTR) 1610 emits light 1620 in one of a plurality of optical wavelengths such as, but not limited to, the ITU wavelength grid of 50 GHz to 100 GHz spacing from 1491.88 nm to 1611.79 nm wavelength. The light 1620 carries RF modulation, received from the ESA antenna array row 1600, imposed by each one of the plurality of ESA antenna element emitter DWDM transmitters 1610 onto the light 1620. The light 1620 subsequently enters a passive DWDM TTD/optical distribution module 1630. The passive DWDM TTD/optical distribution module 1630 delays the light 1620 by intervals of time predetermined for the light 1620 from each one of the plurality of ESA antenna element emitter DWDM transmitters 1610 and each optical wavelength of the light 1620 relative to the other ESA antenna element emitter DWDM transmitters 1610 and other optical wavelengths. The passive DWDM TTD/optical distribution module 1630 outputs light 1640 to a transmit-receive wavelength separator module 1650 such as, but not limited to, an asymmetrical waveguide grating (AWG) or a thin-film optical interference filter. The transmit-receive wavelength separator module 1650 also accepts light 1660 carrying ESA antenna control data for distribution to each one of the plurality of ESA antenna element emitter DWDM transmitters 1610. The transmit-receive wavelength separator module 1650 separates the light 1640 from light with other optical wavelengths such as those wavelengths used for transmit mode or ESA antenna array control, and outputs it as light 1670.

The light 1670 is input to a row receive module 1680 in which it is amplified by an optical amplifier 1690 such as, but not limited to, an EDFA, and output as light 1700 that is detected by an optical detector 1710.

Figure 10:
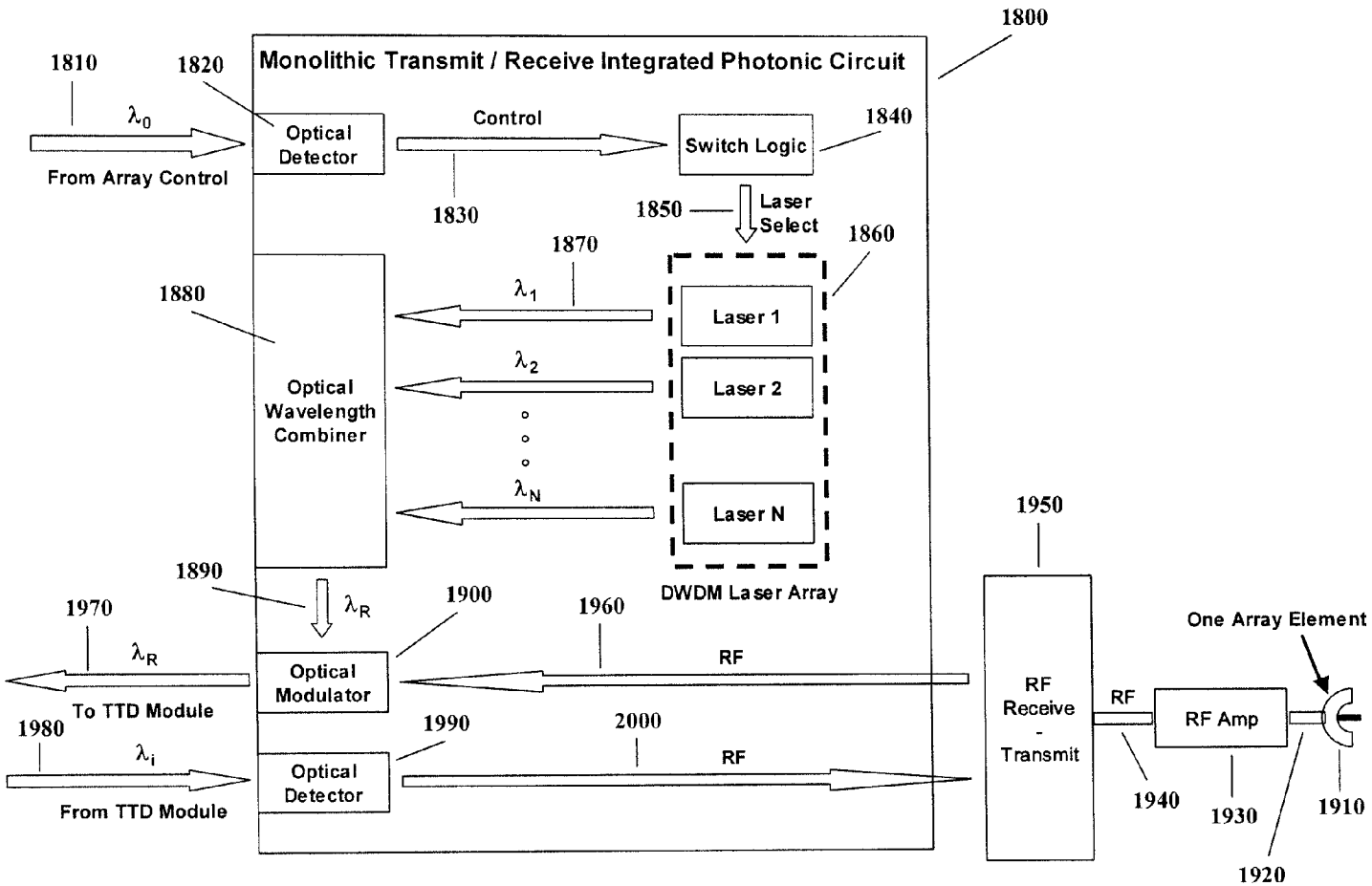
FIG. 10 is a schematic block diagram illustration of a top-level architecture for an integrated optical photonic chip, located at each emitter element, that can implement transmit and receive modes for an RF antenna array.

An embodiment of another architecture for transmit-receive module 1800 that could be employed in a passive, DWDM-based, wavelength-selection, parallel-address approach for photonic true time delay control of RF phase-array antennas with electronic selection of time delays is shown in FIG. 10.

Light 1810 at optical wavelength $\lambda_0$ carries data for beam-steering control of an ESA antenna array and is detected by an optical detector 1820. In receive mode, the optical detector 1820 generates a control signal 1830 that causes a switch logic circuit 1840 to output a laser selection signal 1850 to select one of a plurality of DWDM lasers comprising a DWDM laser array 1860. Light 1870, in one or more of a plurality of optical wavelengths, from the DWDM laser array 1860 are combined by an optical combiner means 1880 such as, but not limited to, an asymmetrical waveguide grating (AWG) or a thin-film optical interference filter, to form light 1890 that is input to an optical modulator 1900.

RF signals received by an ESA antenna array element 1910 sequentially propagate through RF conduit 1920, RF amplifier 1930, RF conduit 1940, and an RF transmit-receive switch 1950. The RF transmit-Receive switch 1950 outputs RF signal 1960 that is subsequently applied to the optical modulator 1900. The optical modulator 1900 imposes the RF signal 1960 onto the light 1890 and outputs light 1970 for further processing elsewhere in the photonic TTD system, as described in other embodiments.

In transmit mode, light 1980 carrying RF modulation is detected by an optical detector 1990. The optical detector 1990 generates an RF signal 2000 that sequentially propagates through the RF transmit-receive switch 1950, the RF conduit 1940, the RF amplifier 1930, the RF conduit 1920, to arrive at the ESA antenna array element 1910 for subsequent RF transmission.

Although the invention has been described with respect to various embodiments, it should be realized this invention is also capable of a wide variety of further and other embodiments within the spirit and scope of the appended claims.

What is claimed is:

1. A passive optical true time delay system comprising:

at least one means for generating light at a plurality of optical wavelengths;

each one of said plurality of optical wavelengths having a plurality of predetermined optical paths associated therewith;

said each one of said plurality of optical wavelengths being utilized for entering at least one of said plurality of predetermined optical paths;

at least one modulator for modulating said light at said plurality of optical wavelengths, only one of said plurality of optical wavelengths being generated by each said at least one means for generating light at a plurality of optical wavelengths;

means for distributing said modulated light at said each one of said plurality of optical wavelengths into a different said at least one of said plurality of predetermined optical paths according to said each one of said plurality of optical wavelengths of said light;

each of said at least one of said plurality of predetermined optical paths incorporates an optical path length to achieve a predetermined optical propagation time interval, selection of each of said at least one of said plurality of predetermined optical paths being determined by optical wavelength;

means for selecting and optically detecting said modulated light having at least one of said plurality of optical wavelengths; and said means for selecting and optically detecting said modulated light having said at least one of said plurality of optical wavelengths outputting a plurality of radio frequency energies, each of said radio frequency energies relating to a different said predetermined optical propagation time interval.

2. The passive optical true time delay system of claim 1 wherein:

at least one of said plurality of radio frequency energies being input to a radiating element of a radio frequency phase array antenna; and said predetermined optical propagation time interval determining a pointing angle of radio frequency energy emitted from said radio frequency phased array antenna.

3. The passive optical true time delay system of claim 2 wherein:

said at least one of said means for generating light at said plurality of optical wavelengths comprises a laser.

4. The passive optical true time delay system of claim 2 wherein:

said means for distributing said modulated light at said plurality of optical wavelengths comprises at least one thin-film optical interference filter.

5. The passive optical true time delay system of claim 2 wherein:

said means for distributing said modulated light at said plurality of optical wavelengths comprises at least one asymmetrical waveguide grating device.

6. The passive optical true time delay system of claim 3 wherein:

said means for distributing said modulated light at said plurality of optical Wavelengths comprises at least one thin-film optical interference filter.

7. The passive optical true time delay system of claim 3 wherein:

of said means for distributing said modulated light at said plurality of optical wavelengths further comprises at least one asymmetrical waveguide grating device.

8. The passive optical true time delay system of claim 2 wherein:

said means for selecting and optically detecting said modulated light having at least one of said plurality of optical wavelengths comprises at least one electronic logic circuit and at least one optical photo detector.

9. The passive optical true time delay system of claim 3 wherein:

said means for selecting and optically detecting said modulated light having at least one of said plurality of optical wavelengths comprises at least one electronic logic circuit and at least one optical photo detector.

10. A passive optical true time delay system comprising:

at least one means for generating light at a plurality of optical wavelengths;

each one of said plurality of optical wavelengths having a plurality of predetermined optical paths associated therewith;

said each one of said plurality of optical wavelengths being utilized for entering at least one of said plurality of predetermined optical paths;

at least one modulator for modulating said light at said plurality of optical wavelengths, only one of said plurality of optical wavelengths being generated by each said at least one means for generating light at a plurality of optical wavelengths;

means for distributing said modulated light at said each one of said plurality of optical wavelengths into a different said at least one of said plurality of predetermined optical paths according to said each one of said plurality of optical wavelengths of said light;

each of said at least one of said plurality of predetermined optical paths incorporates an optical path length to achieve a predetermined optical propagation time interval, selection of each of said at least one of said plurality of predetermined optical paths being determined by optical wavelength;

means for optically detecting said modulated light having said at least one of said plurality of optical wavelengths; and said means for optically detecting said modulated light having said at least one of said plurality of optical wavelengths outputting a plurality of radio frequency energies, each of said radio frequency energies relating to a different said predetermined optical propagation time interval.

11. The passive optical true time delay system of claim 10 wherein:

at least one of said plurality of radio frequency energies being input to a radiating element of a radio frequency phase array antenna; and said predetermined optical propagation time interval determining a pointing angle of radio frequency energy emitted from said radio frequency phased array antenna.

12. The passive optical true time delay system of claim 11 wherein:

said at least one of said means for generating light having a plurality of optical wavelengths comprises a laser.

13. The passive optical true, time delay system of claim 11 wherein:

said means for distributing said modulated light at said plurality of optical wavelengths comprises at least one thin-film optical interference filter.

14. The passive optical true time delay system of claim 11 wherein:

said means for distributing said modulated light at said plurality of optical wavelengths comprises at least one asymmetrical waveguide grating device.

15. The passive optical true time delay system of claim 12 herein:

said means for distributing said modulated light at said plurality of optical wavelengths further comprises at least one thin-film optical interference filter.

16. The passive optical true time delay system of claim 12 wherein:

said means for distributing said modulated light at said plurality of optical wavelengths further comprises at least one asymmetrical waveguide grating device.

17. The passive optical true time delay system of claim 11 wherein:

said means for optically detecting said modulated light comprises at least one optical photo detector.

18. The passive optical true time delay system of claim 12 wherein:

said means for optically detecting said modulated light comprises at least one optical photo detector.

* * * * *

UNITED STATES PATENT AND TRADEMARK OFFICE

CERTIFICATE OF CORRECTION

PATENT NO. : 8,400,355 B1
APPLICATION NO. : 12/418272
DATED : March 19, 2013
INVENTOR(S) : Celestino John Gaeta It is certified that error appears in the above-identified patent and that said Letters Patent is hereby corrected as shown below:

In the Claims:

In Column 11, line 9 (claim 6), “Wavelengths” should read -- wavelengths --

In Column 11, line 13 (claim 7), “of said means” should read -- said means --

In Column 12, line 33 (claim 15), “herein:” should read -- wherein --

Signed and Sealed this
Fourteenth Day of May, 2013

Teresa Stanek Rea
*Acting Director of the United States Patent and Trademark Office*